US005655228A

United States Patent [19]

Chiang

[11] Patent Number: 5,655,228

[45] Date of Patent: Aug. 12, 1997

[54] GOGGLES

[76] Inventor: Herman Chiang, 11F, No. 634-9, Ching-Ping Rd., Chung-Ho City, Taipei Hsien, Taiwan

[21] Appl. No.: 644,063

[22] Filed: May 9, 1996

[51] Int. Cl.[6] ..... A61F 9/02

[52] U.S. Cl. ..... 2/428

[58] Field of Search ..... 2/428, 429, 430, 2/452, 445, 446, 440

[56] References Cited

U.S. PATENT DOCUMENTS

| | | | |
|---|---|---|---|
| 4,087,865 | 5/1978 | Garofalo | 2/428 |
| 4,171,543 | 10/1979 | Cressi | 2/428 |
| 4,689,837 | 9/1987 | Bolle | 2/428 X |
| 5,408,702 | 4/1995 | Chiang . | |

*Primary Examiner*—Peter Nerbun
*Attorney, Agent, or Firm*—Cushman Darby & Cushman, IP Group of Pillsbury Madison & Sutro, LLP

[57] ABSTRACT

A pair of goggles is to be used in athletic events and is adapted to make a watertight seal around the eyes of a wearer. The goggles include a nosepiece, a pair of eyepieces interconnected by the nosepiece, and a head strap having two ends respectively connected to two strap connecting end portions of the eyepieces. Each of the eyepieces includes a substantially planar lens made of a rigid material, and an integrally formed lens frame body made of a plastic material. The frame body has a front annular wall with a first thickness sufficient to resist deformation in a direction perpendicular to the planar lens, and an eye socket contacting unit which extends rearwardly from an inner periphery of the annular wall. The socket contacting unit is formed by an annular portion and an annular flared portion which extends radially and outwardly from the annular portion. The socket contacting unit has a second thickness less than the first thickness so that, when forced against the eye sockets of the wearer, flexing of the flared portion pushes a brim section thereof toward an outer periphery of the rear section of the annular wall so as to reduce an exposing area of the flared portion outwardly from the outer periphery of the rear section of the annular wall.

5 Claims, 5 Drawing Sheets

GOGGLES

BACKGROUND OF THE INVENTION

1. Field of the Invention

This invention relates to eye protectors, more particularly to eye goggles which may be worn during swimming, skiing and other sports.

2. Description of the Related Art

Many types of goggles for the protection of one's eyes during the pursuit of athletic endeavors have been invented in the past. None has been fully appreciated by all professional swimmers because some of the goggles are made of a rigid material so that they are relatively heavy, are not comfortable to wear and generally cannot provide an adequate seal between the eye sockets of the wearer and the peripheral edges of the goggles. Other goggles are made of a soft material such that the lens frame body is easily deformed during use.

Referring to FIG. 1, a pair of swimming goggles 1 worn by a professional swimmer is shown to include a nose bridge (not visible) and two eyepieces 11 interconnected by the nose bridge. Each of the eyepieces 11 is made of a rigid material and has a relatively small size so as not to retard the swimming speed of the user. In use, the eyepieces 11 are fastened tightly around the head of the swimmer such that the rear periphery of the eyepieces 11 are located within the eye sockets of the swimmer (generally under the eyebrows), thereby providing a watertight seal. However, the goggles 1 can cause discomfort because of the rigidity of the eyepieces 11.

Referring to FIG. 2, a pair of conventional swimming goggles 10 used by an ordinary swimmer is shown to include two lens frames 101 and a nose bridge (not visible) interconnecting the lens frames 101. In order to provide watertight seal, each of the lens frames 101 is formed with an eye socket contacting unit 102 at the rear end portion thereof. When worn, the socket contacting unit 102 covers the entire eye socket of the swimmer (including a portion of the eyebrow) and does not cause discomfort to the swimmer. However, the socket contacting unit 102 has a relatively large size so that the swimming speed of the user is retarded. Thus, the known goggles do not conform to the needs of professional athletes.

SUMMARY OF THE INVENTION

Therefore, it is an object of this invention to provide a pair of eye goggles which does not deform easily during use and which can conform to and satisfy the needs of professional athletes.

Another object of this invention is to provide a pair of eye goggles having eyepieces with a pair of eye socket contacting units which can conform exactly to the shape of a bone structure surrounding the eye sockets in such a manner that the peripheral edges of the socket contacting units bend inwardly relative to the lens frame bodies in use so as to reduce an exposing area of the contacting units from the lens frame bodies and so as not to retard the swimming speed of the wearer.

A further object of this invention is to provide a pair of eye goggles having socket contacting units with a brim section to provide a watertight seal between the eye sockets of the wearer and to provide comfort to the eyes when the goggles are in use.

Accordingly, a pair of goggles of this invention, which is ideal for use in athletic events and which is adapted to make a watertight seal around the eyes of the wearer, includes a nosepiece, a pair of eyepieces interconnected by the nosepiece, and a head strap having two ends respectively connected to two strap connecting end portions of the eyepieces. Each of the eyepieces includes a substantially planar lens made of a rigid material, and an integrally formed lens frame body made of a plastic material. The frame body includes a front annular wall with a front section and a rear section. The front section is formed with an annular groove on an inner surface thereof for insertion of a peripheral portion of the planar lens. The rear section forms a first contour substantially conforming to a shape of the bone structure surrounding a human eye socket. The annular wall has a first thickness sufficient to resist deformation in a direction perpendicular to the planar lens. An eye socket contacting unit extends rearwardly from the inner periphery of the rear section of the annular wall and forms a second contour similar to the first contour. The eye socket unit is formed by an annular portion and an annular flared portion which extends radially and outwardly from the annular portion and which has a second thickness less than the first thickness of the annular wall so that, when forced by the head strap to abut against the eye socket, the flared portion bends toward the front section of the annular wall. The flared portion includes an upper part, a lower part and a lateral part which is adjacent to the nosepiece. The upper part, lower part and lateral part of the flared portion cooperatively define a brim section that is spaced from and bent toward the outer periphery of the rear section of the annular wall. Upon pressing of the rear section of the annular flared portion against the eye socket, flexing of the flared portion pushes the brim section toward the outer periphery of the rear section of the annular wall so as to reduce an exposing area of the flared portion outwardly of the outer periphery of the rear section of the annular wall. Thus, the eye socket contacting unit of the eyepiece does not retard the swimming speed of the wearer.

BRIEF DESCRIPTION OF TEE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
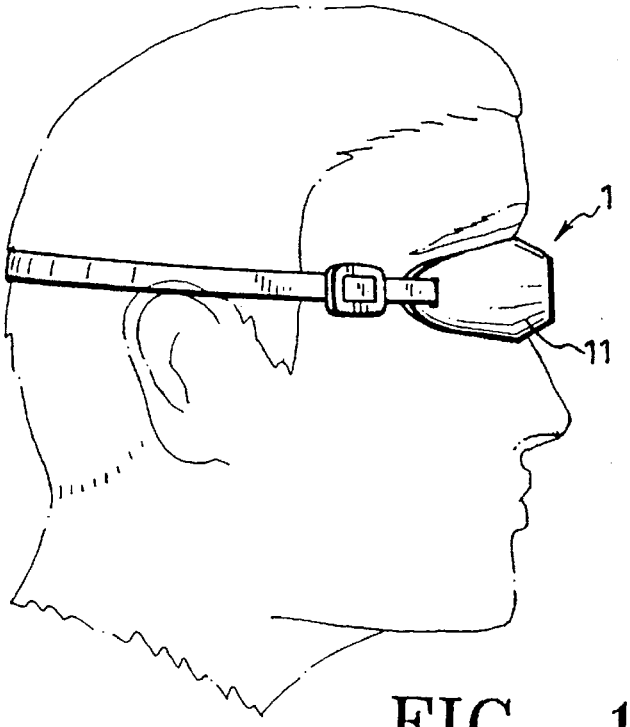
FIG. 1 (PRIOR ART)
FIG. 1 illustrates conventional goggles worn by a professional swimmer.
Figure 2:
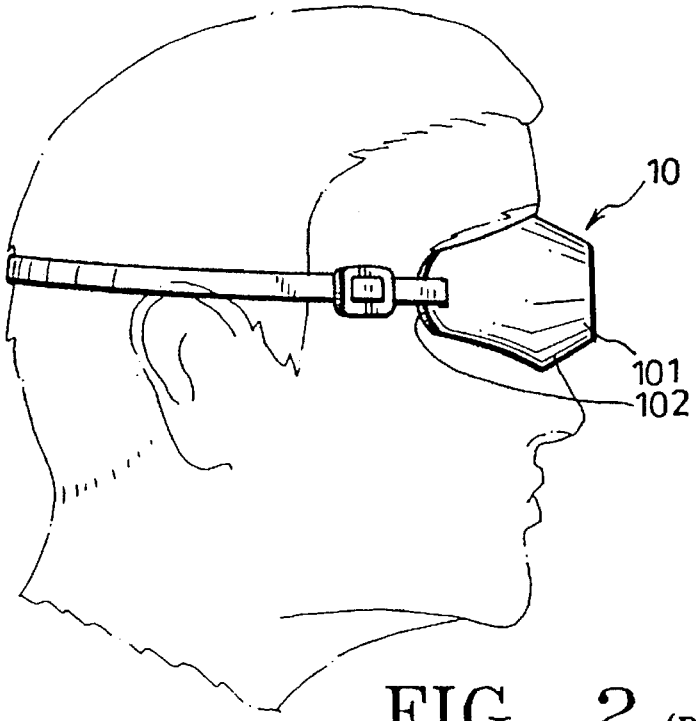
FIG. 2 (PRIOR ART)
FIG. 2 illustrates conventional goggles worn by an ordinary swimmer.
Figure 3:
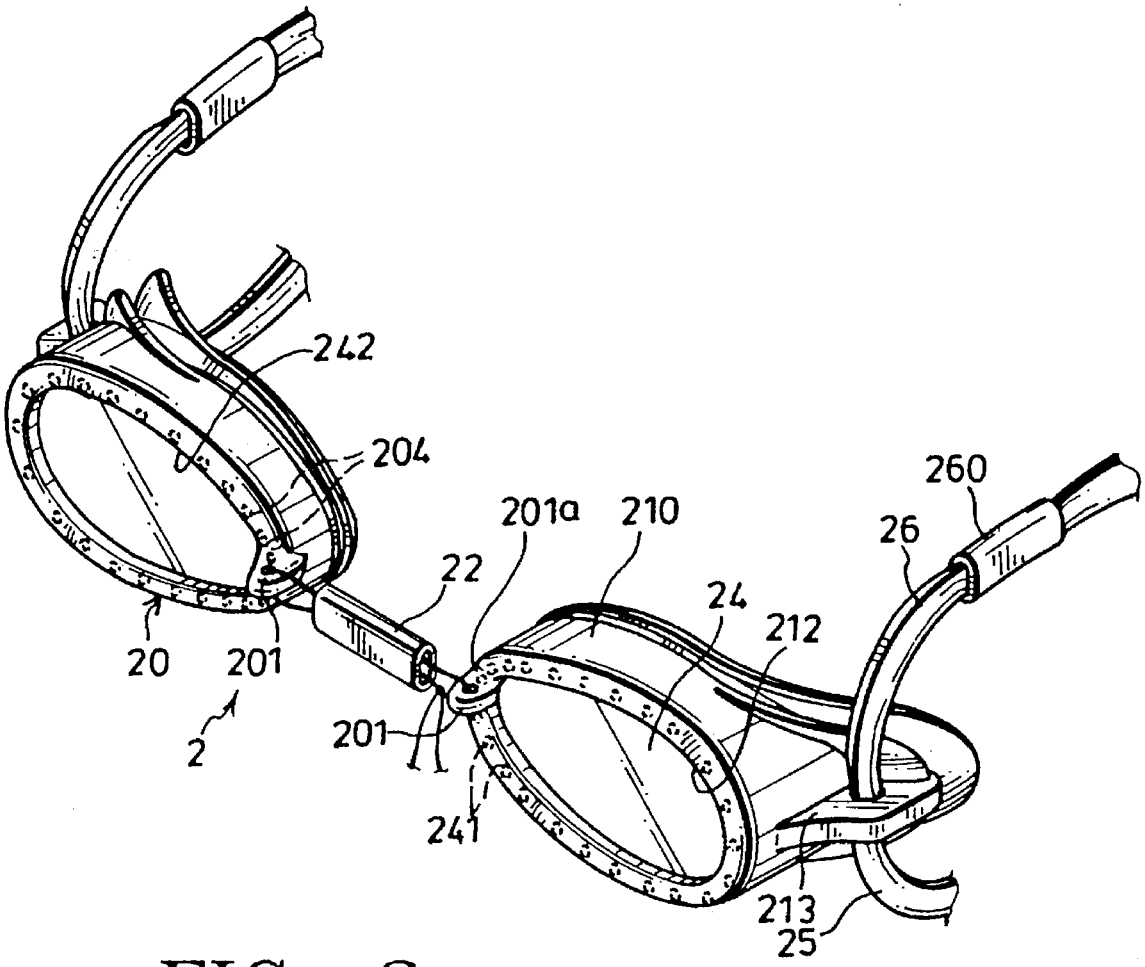
FIG. 3 is a perspective view of a pair of swimming goggles of this invention.
Figure 4:
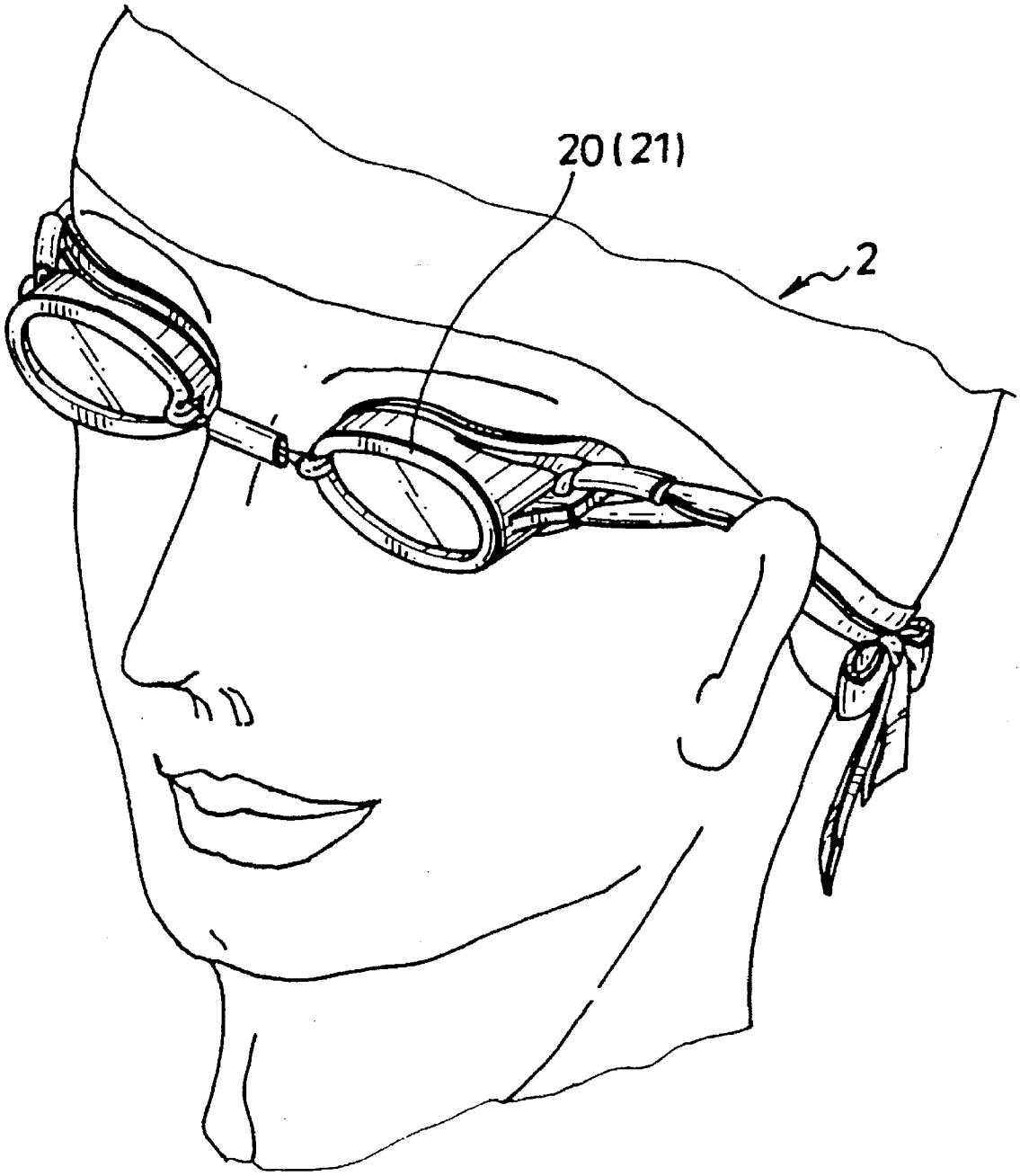
FIG. 4 illustrates the goggles of this invention when worn by a swimmer.

Referring to FIGS. 3 and 4, the preferred embodiment of a pair of goggles 2 of this invention is ideal for use in athletic events and is worn by a professional swimmer such that a watertight seal is formed around the eyes of the swimmer. The goggles 2 include a nosepiece 22, a pair of eyepieces 20 interconnected by the nosepiece 22, and a head strap 26 having two ends 25 respectively connected to two strap connecting end portions 213 of the eyepieces 20.

Figure 5A:
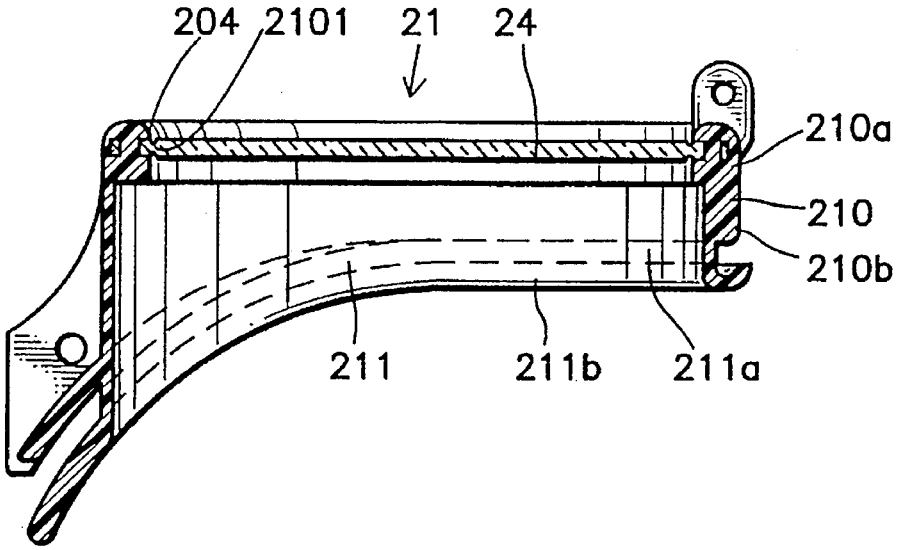
FIGS. 5A and 5B show sectional and perspective views of an eyepiece of the goggles of this invention before being compressed by the wearer.
Figure 5B:
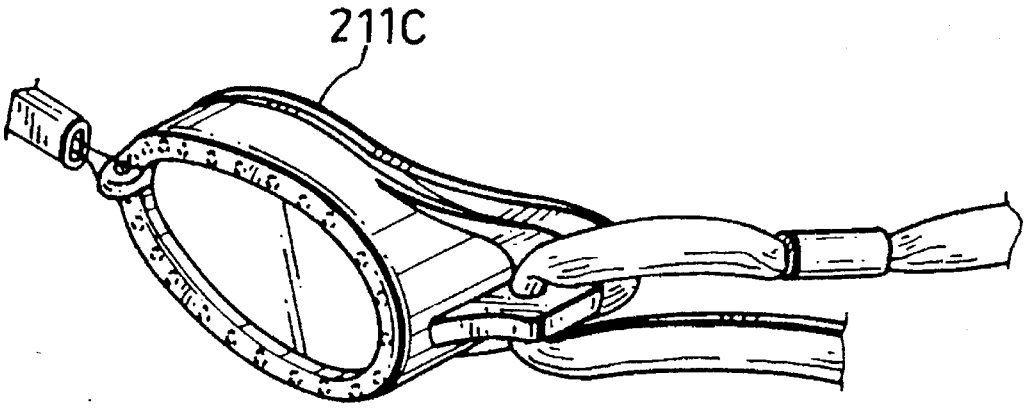

Referring to FIGS. 3, 5A and 5B, each of the eyepieces 20 includes a substantially planar lens 24 made of a rigid material, such as a cellulose propionate anti-fog sheet that is 1.5 mm in thickness, and an integrally formed lens frame body 21 made of a plastic material, such as PVC. The frame body 21 includes a front annular wall 210 with a front section 210*a* and a rear section 210*b*. The front section 210*a* is formed with an annular groove 2101 on an inner surface thereof within which a peripheral portion of the planar lens 24 is inserted, thereby retaining the planar lens 24 on the frame body 21. The rear section 210*b* forms a first contour substantially conforming to the shape of the bone structure surrounding a human eye socket. The annular wall 210 has a first thickness sufficient to resist a force which is applied in a direction perpendicular to the planar lens 24 so as to prevent deformation of the frame body 21.

An eye socket contacting unit 211 extends integrally and rearwardly from the inner periphery of the rear section 210*b* of the annular wall 210 and has a second contour similar to the first contour of the rear section 210*b* of the annular wall 210. The eye socket contacting unit 211 is formed by an annular portion 211*a* and an annular flared portion 211*b* which extends radially and outwardly from the annular portion 211*a*. The annular portion 211*a* and the annular flared portion 211*b* of the eye contacting unit have a second thickness less than the first thickness of the annular wall 210 so that, when forced by the head strap 26 (see FIG. 3) to abut against the eye sockets of the wearer, the flared portion 211*b* bends toward the rear section 210*b* of the annular wall 210.

Figure 6A:
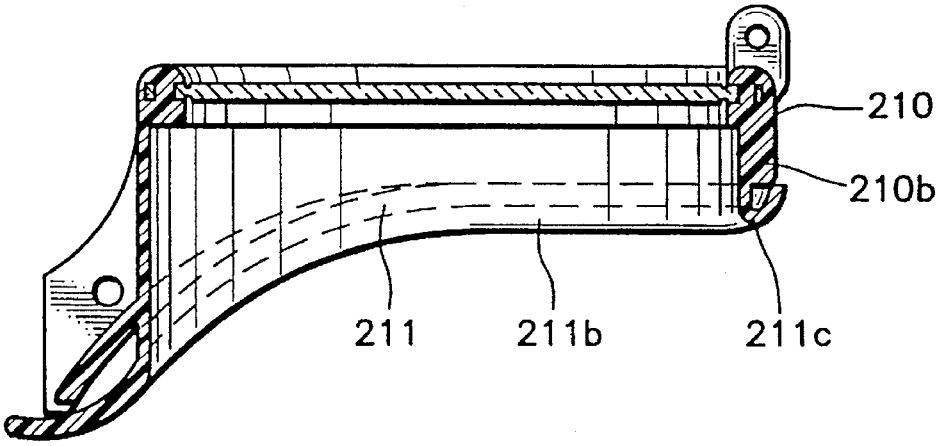
FIGS. 6A and 6B show sectional and perspective views of an eyepiece of the goggles of this invention when compressed by the wearer.
Figure 6B:
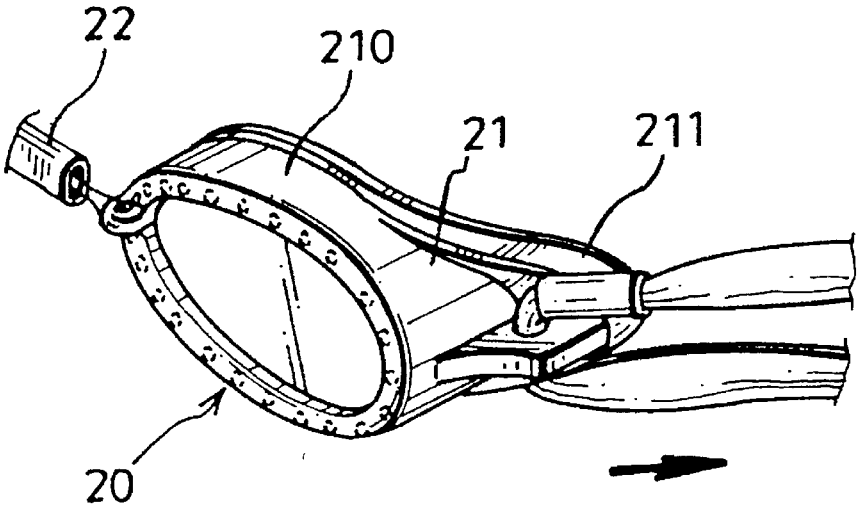

As illustrated in FIGS. 6A and 6B, the flared portion 211*b* includes an upper part, a lower part and a lateral part adjacent to the nosepiece 22, which bend toward and are spaced slightly from the outer periphery of the rear section 210*b* of the annular wall 210 at a normal condition and which cooperatively define a brim section 211*c*. Thus, upon pressing against the eye socket, flexing of the annular flared portion 211*b* pushes the brim section 211*c* toward the outer periphery of the rear section 210*b* of the annular wall 210 in such a manner that an outwardly exposing area of the flared portion 211*b* is reduced relative to the outer periphery of the rear section 210*b* of the annular wall 210. Therefore, the eye socket contacting unit 211 of the eyepiece 20 does not retard the swimming speed of the wearer.

Referring again to FIG. 3, the planar lens 24 includes a plurality of through holes 241 formed circumferentially through the peripheral portion thereof. Since the lens 24 is disposed in advance in a die within which the goggles of this invention are to be moulded, circumferentially disposed ribs 204 are formed integrally with the front section of the annular wall 210 and extend through the holes 241 respectively, thereby enhancing the engagement between the annular groove 2101 (see FIG. 5A) of the annular wall 210 and the peripheral portion of the planar lens 24. Each of the eyepieces 20 further has a lug 201 protruding forwardly and integrally from the front section of the annular wall 210 for attachment of the nosepiece 22. The lug 201 has an enlarged rear end portion integrally formed with the front section of the annular wall 210, a generally pointed front end portion and two curved ridges 201*a* between the rear and front end portions thereof. The rear end portion of the lug 201 has a thickness sufficient to resist lateral outward deformation of the lug due to lateral pull by the nosepiece 22 and the elastic head strap 26 so as to prevent disruption of the watertight seal between the front section of the annular wall 210 and the planar lens 24 when the goggles are in use. Note that the density of the ribs 204 adjacent to the lug 201 is greater than the density of those farther from the lug 201. This arrangement further increases the stretchability of the lens frame body 21 so as to prevent deformation. Each lens 24 further has a looped channel 242 which is formed in an external surface thereof and which is located in the vicinity of the through holes 241 so as to permit extension of an annular stopper of the mould after the lens 24 is inserted in the latter when forming the eyepiece 20. When molten plastic is injected into the mould, the annular stopper prevents the molten plastic from spilling into the looped channel 242 of the lens 24 so that upon hardening and removal from the mould, the inner edge 212 of the plastic portion that defines the annular groove 2101 (see FIG. 5A) is formed integrally with the peripheral portion of the planar lens 24. The watertight seal and engagement therebetween are further enhanced. The head strap 26 is provided with a pair of stoppers 260, in the form of sleeves, respectively sleeved on two end portions thereof. The stoppers 260 prevent the strap 26 from being pulled by the ends 25 of the strap 26 so as to alter tension of the strap portion located between the stoppers 260.

With this invention thus explained, it is obvious to those skilled in the art that various modifications and variations can be made without departing from the scope and spirit thereof. It is therefore intended that the invention be limited only as in the appended claims.

I claim:

1. Goggles for use in swimming and adapted to form a substantially watertight seal around eyes of a wearer, said goggles including:

a nosepiece, a pair of separate eyepieces interconnected by said nosepiece, and a head strap having two ends which engage two strap connecting end portions of said eyepieces respectively, wherein the improvement comprises:

each of said eyepieces including a substantially planar lens made of a rigid material, and an integrally formed lens frame body made of a plastic material, said frame body having a front annular wall with a front section and a rear section, said front section having an annular groove on an inner surface thereof for insertion of a peripheral portion of said planar lens to establish engagement therebetween, said rear section forming a first contour substantially conforming to a bone structure surrounding a human eye socket to enable said substantially watertight seal to be effected when each of said eyepieces is placed over the eyes of the wearer, said annular wall having a first thickness sufficient to resist deformation in a direction perpendicular to said planar lens;

an eye socket contacting unit extending rearwardly from an inner periphery of said rear section of said annular wall and having a second contour similar to said first contour, said eye socket contacting unit having an annular portion and an annular flared portion extending radially and outwardly from said annular portion, said eye socket contacting unit further having a second thickness less than first thickness of said annular wall so as to permit flexing thereof when forced by said head strap to abut against the eye socket, said annular flared portion including an upper part, a lower part and a lateral part adjacent to said nosepiece, said upper, lower and lateral parts being bent toward and spaced from an outer periphery of said rear section and cooperatively defining a brim section, said rear section of said annular wall and said annular portion and said annular flared portion of said eye socket contacting unit being constructed and arranged so that upon pressing of said annular flared portion against the eye socket to effect said substantially watertight seal, said annular flared portion flexes so as to move said brim section toward and inward of an outer periphery of said rear section of said annular wall to reduce an exposing area of said annular flared portion outwardly from the outer periphery of said rear section.

2. Goggles according to claim 1, wherein said planar lens has a plurality of through holes disposed circumferentially in the peripheral portion thereof, said front section of said annular wall having a plurality of circumferentially disposed ribs which are transverse to said annular groove and which extend through said holes respectively so as to enhance engagement between said annular groove and said peripheral portion of said planar lens.

3. Goggles according to claim 2, wherein the engagement between said annular groove and said peripheral portion of said planar lens is formed by injection moulding, thereby integrally forming said ribs with a portion of said front section which defines said annular groove and accordingly forming a watertight seal between said front section and said planar lens.

4. Goggles according to claim 3, wherein said front section of said annular wall has a lug protruding forwardly and integrally therefrom for attachment of said nosepiece to said eyepiece, said lug having an enlarged rear end portion formed integrally with said front section of said annular wall, a generally pointed front end portion and two curved ridges between said rear and front end portions, said rear end portion of said lug having a thickness sufficient to resist lateral outward deformation of said lug due to lateral pull by said nosepiece and said elastic head strap so as to prevent disruption of the watertight seal between said front section of the annular wall and said planar lens when said goggles are in use.

5. Goggles according to claim 4, wherein density of said ribs near said lug is greater than density of said ribs farther from said lug in order to assist in preventing deformation of said lens frame body when said lens frame body is stretched.

* * * * *